US006082985A

United States Patent [19]

Suzuki et al.

[11] Patent Number: 6,082,985

[45] Date of Patent: Jul. 4, 2000

[54] SCREW COMPRESSOR

[75] Inventors: Katsuyuki Suzuki; Noboru Tsuboi; Masaki Matsukuma, all of Hyogo, Japan

[73] Assignee: Kabushiki Kaisha Kobe Seiko Sho, Kobe, Japan

[21] Appl. No.: 09/149,663

[22] Filed: Sep. 9, 1998

[30] Foreign Application Priority Data

Sep. 10, 1997 [JP] Japan ..... 9-245210

[51] Int. Cl.[7] ..... F01C 1/24

[52] U.S. Cl. ..... 418/201.2

[58] Field of Search ..... 418/201.2; 92/165 R, 92/155

[56] References Cited

U.S. PATENT DOCUMENTS

| | | | |
|---|---|---|---|
| 3,088,659 | 5/1963 | Nilsson et al. | 418/201.2 |
| 3,146,683 | 9/1964 | Hoffmann | 92/155 |
| 3,149,543 | 9/1964 | Naab | 92/155 |
| 3,432,089 | 3/1969 | Schibbye . | |
| 3,877,846 | 4/1975 | Lundberg | 418/201 |
| 4,913,634 | 4/1990 | Nagata et al. | 418/47 |
| 5,921,166 | 7/1999 | Machida et al. | 92/165 R |

FOREIGN PATENT DOCUMENTS

| | | | |
|---|---|---|---|
| 1920374 | 4/1969 | Germany | 92/155 |
| 195 12 950 | 10/1996 | Germany . | |
| 56-081674 | 1/1982 | Japan | 418/201.2 |

*Primary Examiner*—Thomas Denion
*Assistant Examiner*—Theresa Trieu
*Attorney, Agent, or Firm*—Oblon, Spivak, McClelland, Maier & Neustadt, P.C.

[57] ABSTRACT

A screw compressor to enable prevention of contact between a slide valve and screw rotors. The screw compressor comprising a capacity controlling slide valve 3 provided for advance and (or) retreat through a piston rod 6 by a piston 5 operated by fluid pressure arranged on the discharge side to adjust the size of a diametral opening of screw rotors 1, 2 on the suction side, the screw compressor including projections 8 extending in parallel with axes of the screw rotors 1, 2 from a position distanced from the screw rotors 1, 2 at the end on the suction side of the slide valve 3, and a support portion 10 which comes in relatively slidably contact with surfaces 9 on the axial side of the screw rotors 1, 2 of the projections 8 which advance and retreat along with the slide valve 3 to support the projections 8.

2 Claims, 3 Drawing Sheets

SCREW COMPRESSOR

BACKGROUND OF THE INVENTION

1. Field of the Invention

The present invention relates to a screw compressor provided with a capacity controlling slide valve.

2. Prior Art

A screw compressor provided with a capacity controlling slide valve 21 shown in FIGS. 7 and 8 has been heretofore well known (Japanese Patent Publication No. 7-62477). The slide valve 21 is coupled to a piston rod 23 of a hydraulic cylinder 22 arranged on the discharge side, and is provided for advance and (or) retreat along with a piston 25 through the piston rod 23 extending through a discharge port 24. As is known, the slide valve 21 comes in sliding contact with the internal surface of a casing opposite to, that is, on the back side of a pair of male and female screw rotors 26, 27, for advance and (or) retreat. The slide valve 21 operates to adjust the size of an opening in a diametral direction on the suction side of the screw rotors 26, 27. It is noted that only the opening 29 in the diametral direction of the one screw rotor 26 is shown in FIG. 8.

In the compressor, a side cover 31 on the discharge side formed with a discharge axial port 30 is provided with a projection 32 for controlling the diametral movement of the slide valve 21 (which is shown by the cross hatching in FIG. 7). The surface on the slide valve 21 side of the projection 32 comprises the guide surface which slidably contacts with the slide valve 21.

In the case of the aforementioned conventional compressor, compressed gas from the discharge port 24 moves into a fine clearance between the slide valve 21 and the internal surface of the casing 28 behind the slide valve 21. The pressure caused by the compressed gas presses on the back of the slide valve 21 as shown by the arrow A in FIG. 8. The diametral movement on the discharge side of the slide valve 21 can be controlled by the projection 32 with respect to the back pressure exerting on the slide valve 21. On the other side, however, the slide valve 21 cannot be prevented from being flexed towards the screw rotors 26, 27, on the suction side, as shown by the arrow B in FIG. 8. This poses problems in that the back pressure causes the contact between the slide valve 21 and the screw rotors 26, 27, the damage of the slide valve 21, and the screw rotors 26, 27 resulting therefrom, the abnormal noises, the lowering of performance, and the like.

The present invention has been accomplished in order to eliminate such problems as noted above with respect to prior art. It is an object of the present invention to provide a screw compressor which enables prevention of contact between a slide valve and screw rotors.

SUMMARY OF THE INVENTION

For solving the aforementioned problems, the present invention provides a screw compressor comprising: a pair of male and female screw rotors meshed with each other; a slide valve for adjusting the size of an opening in a diametral direction on the suction side of the screw rotors; projections extending in parallel with axes of the screw rotors from a position distanced from the screw rotors at an end on the suction side of the slide valve; and a support portion which comes in slidable contact with the surfaces on the axial side of the screw rotors of the projections to support the projections.

Preferably, a plurality of surfaces of the support portion which the projections contact are provided at a position distanced from the axis of the slide valve.

Further, preferably, in the case where a piston is present which is arranged on the discharge side of the slide valve and coupled to the slide valve through a piston rod, and the slide valve is operated by fluid pressure applied to the piston, in addition to the aforementioned constitution, a seal member provided in the outer peripheral portion of the piston and an annular slide member provided at a position distanced from the seal member in the outer peripheral portion of the piston are mounted.

Details of the present invention and other objects thereof will become apparent from the ensuing description with reference to the accompanying drawings.

DETAILED DESCRIPTION OF THE PREFERRED EMBODIMENTS

The embodiments of the present invention will be explained hereinafter with reference to the drawings.

Figure 1:
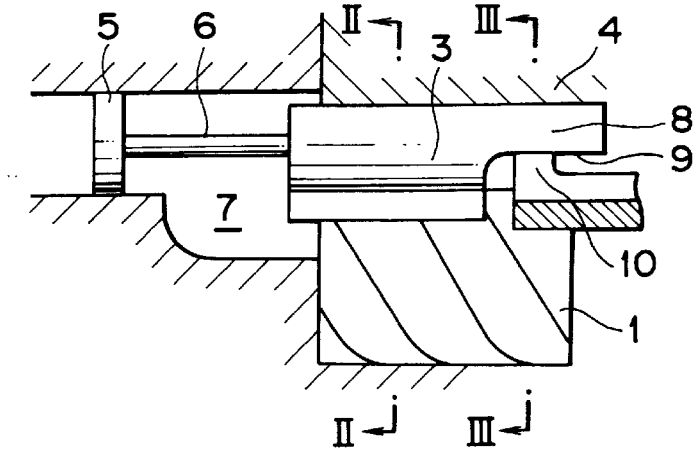
FIG. 1 is a sectional view of a screw compressor according to a first embodiment of the present invention.
Figure 2:
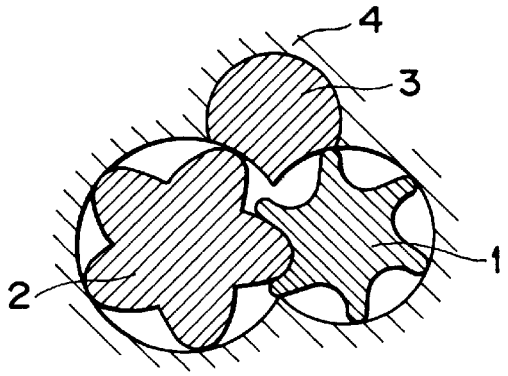
FIG. 2 is a sectional view taken on line II—II of FIG. 1.
Figure 3:
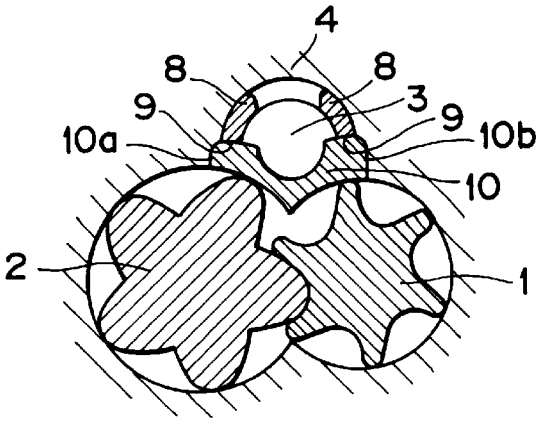
FIG. 3 is a sectional view taken on line III—III of FIG. 1.
Figure 7:
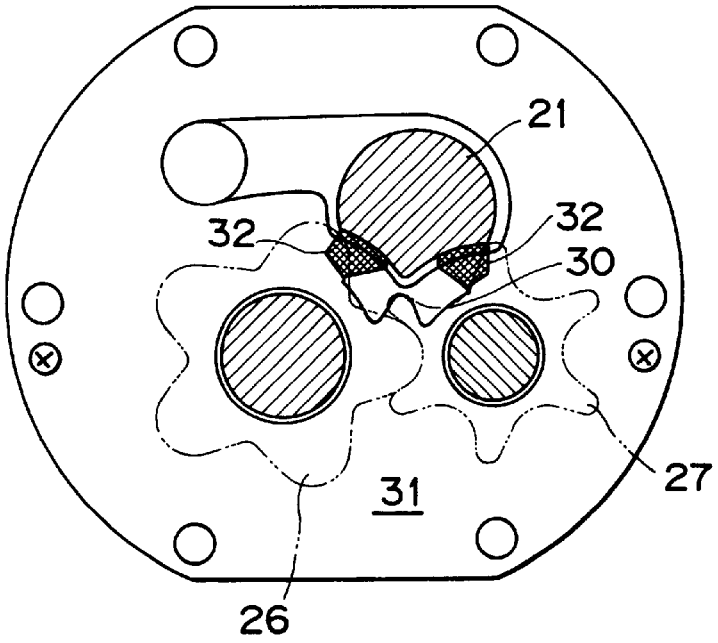
FIG. 7 PRIOR ART
FIG. 7 is a view of showing the discharge side of a conventional screw compressor.
Figure 8:
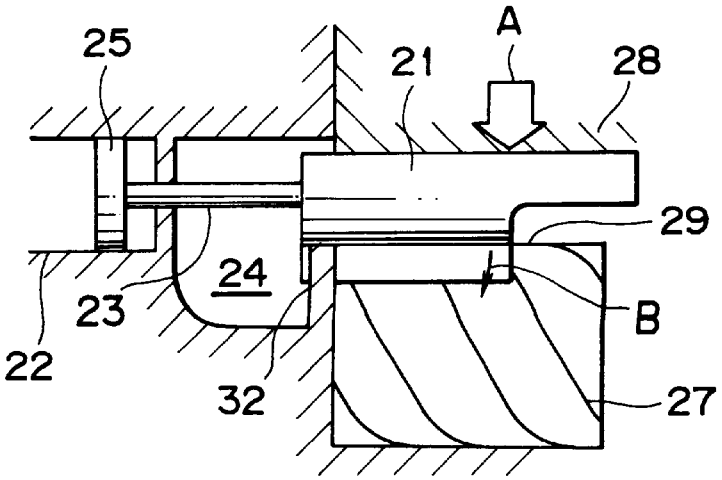
FIG. 8 PRIOR ART
FIG. 8 is a fragmentary sectional view of the compressor shown in FIG. 7.

FIGS. 1 to 3 show a screw compressor according to a first embodiment of the present invention. A mutual relationship between screw rotors 1, 2, a slide valve 3, and a casing 4 is similar to the case of a compressor shown in FIGS. 7 and 8.

The slide valve 3 is coupled to a piston 5 arranged on the discharge side through a piston rod 6. In FIG. 1, in the first case where the piston 5 is moved to the right to increase the capacity of the compressor, pressure oil is guided to a space on the left side of the piston 5. Conversely, in the second case where the piston 5 is moved to the left to decrease the capacity of the compressor, pressure oil in the space on the left side lets escape outside the space. Since the force for pressing the slide valve 3 toward the discharge side always exerts on the slide valve 3 by means of a spring not shown, in the second case, pressure of a discharge port 7 is further applied by the spring force during the operation of the compressor so that the slide valve 3 moves leftward.

Further, the compressor includes two projections 8 extending in parallel with axes of the screw rotors 1, 2 from a position distanced from the screw rotors 1, 2 at an end on the suction side of the slide valve 3, and a support portion 10 which comes in relatively slidably contact with surfaces 9 on the axial side of the screw rotors 1, 2 of the projections 8 which advance and (or) retreat along with the slide valve 3 to support the projections 8. The slide valve 3 is kept in the so-called opposite-end support state through the piston 5 restricted in the diametral movement on the discharge side and through the projections 8 supported by the support portion 10 so as to restrict the diametral movement thereof.

In FIG. 3, the aforesaid surfaces 9 are placed in contact with two surfaces 10*a*, 10*b* positioned on the upper side of the support portion 10 and at a part distanced to left and right from the axis of the slide valve 3. With such a constitution as described, the movement of the slide valve 3 in the rotational direction of the central axis thereof is restricted.

Accordingly, back pressure exerts on the slide valve 3 similar to the case of the aforementioned compressor, but the slide valve 3 is not flexed toward the screw rotors 1, 2 sides even on the suction side as well as the discharge side so as to overcome the contact trouble between the slide valve 3 and the screw rotors 1, 2.

Note, for the portions of the piston 5 and the piston rod 6, the construction of the hydraulic cylinder may be employed similar to the case of the aforementioned compressor.

Figure 4:
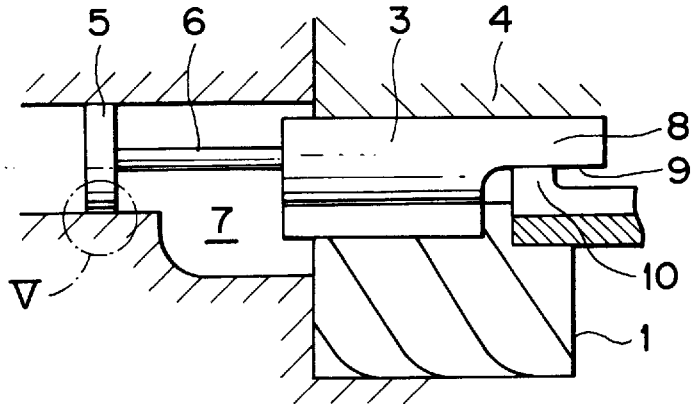
FIG. 4 is a sectional view of a screw compressor according to a second embodiment of the present invention.
Figure 5:
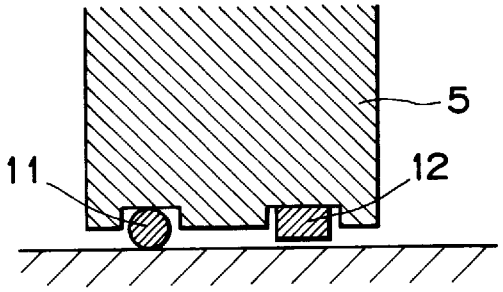
FIG. 5 is an enlarged sectional view of a V portion of FIG. 4.
Figure 6:
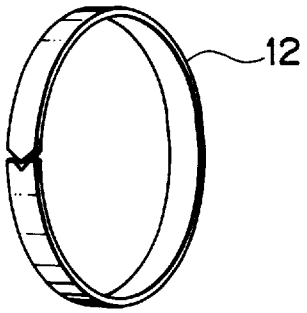
FIG. 6 is a perspective view of a slide member of FIG. 4.

FIGS. 4 to 6 show a screw compressor according to a second embodiment of the present invention. Parts common to those of the screw compressor according to the first embodiment shown in FIGS. 1 to 3 are indicated by the same reference numerals, description of which is omitted.

On the screw compressor are mounted an O-ring 11 as one example of a seal member provided in the outer peripheral portion of the piston 5, and in addition, an annular slide member 12 in the outer peripheral portion of the piston 5 and at a position distanced from the O-ring 11. The slide member 12 is formed from a member which is small in sliding friction during the sliding such as fluorocarbon resin, for example, polytetrafluoroethylene.

Further, the periphery of the piston 5 is sealed by the O-ring 11. The slide member 12 is not aimed at sealing. Accordingly, in the state where the piston 5 is not inclined as shown in FIG. 5, the sliding member 12 need not be placed in contact with the inner wall surface surrounding the periphery of the sliding member 12.

On the other hand, when the great force exerts on the piston 5 to incline the latter so that the piston 5 is excessively inclined, the O-ring 11 becomes deformed. Therefore, there is a possibility that the piston 5 comes in contact with the aforesaid inner wall surface to increase the sliding friction so that the piston 5 is not operated smoothly, as the case may be. However, in the present screw compressor, the sliding member 12 is provided. Therefore, when the piston 5 starts to incline, the sliding member 12 comes in contact with the aforesaid inner wall surface before the angle of inclination becomes large to thereby prevent the angle of inclination from being increased. Furthermore, since the sliding friction between the sliding member 12 and the aforesaid inner wall surface is small, the smooth operation of the piston 5 is maintained.

While in FIG. 5, an example is shown in which the O-ring 11 and the sliding member 12 are arranged on left-hand and right-hand, respectively, it is to be noted that the present invention is not limited thereto but the present invention includes the screw compressor in which the O-ring 11 and the sliding member 12 are arranged on right-hand and left-hand, respectively.

As will be apparent from the foregoing, the present invention provides a screw compressor comprising: a pair of male and female screw rotors meshed with each other; a slide valve for adjusting the size of an opening in a diametral direction on the suction side of the screw rotors; projections extending in parallel with axes of the screw rotors from a position distanced from the screw rotors at an end on the suction side of the slide valve; and a support portion which comes in slidable contact with the surfaces on the axial side of the screw rotors of the projections to support the projections.

Therefore, there occurs no contact between the slide valve and the screw rotors caused by the back pressure of the slide valve. This brings forth the effect of the avoidance of damage given to the slide valve and the screw rotors caused by the aforesaid contact, and the solution of abnormal noises, while maintaining the performance of the compressor.

Preferably, a plurality of surfaces of the support portion which the projections contact are provided at a position distanced from the axis of the slide valve.

With this, there provides a further effect, in addition to the effect just mentioned above, in that as compared with the case where a narrow single surface is formed for the support portion to contact the projections, the displacement of the slide valve in the rotational direction of the axis thereof is also solved while relieving pressure applied to the contact surface.

Further, preferably, in the case where a piston is present which is arranged on the discharge side of the slide valve and coupled to the slide valve through a piston rod, and the slide valve is operated by fluid pressure applied to the piston, a seal member provided in the outer peripheral portion of the piston and an annular slide member provided at a position distanced from the seal member in the outer peripheral portion of the piston are mounted in addition to the aforementioned constitution.

Thereby, there provides a further effect, in addition to the effects mentioned above, in that even if the excessive force exerts on the piston to incline the latter, the smooth operation of the piston is assured.

What is claimed is:

1. A screw compressor comprising:

a pair of male and female screw rotors meshed with each other;

a slide valve for adjusting the size of an opening in a diametral direction on the suction side of said screw rotors;

projections extending in parallel with axes of said screw rotors from a position distanced from said screw rotors and at an end on the suction side of said slide valve; and a support portion which comes in slidable contact with surfaces of said screw rotors of said projections to support said projections, wherein the surfaces of said projections are provided at positions distanced at opposite sides of a central axis of said slide valve.

2. The screw compressor according to claim 1, further comprising:

a piston arranged on the discharge side of said slide valve and coupled to said slide valve through a piston rod, said slide valve being operated by fluid pressure;

a seal member provided in the outer peripheral portion of said piston; and an annular slide member provided at a position distanced from said seal member in the outer peripheral portion of said piston.

* * * * *